US006396212B2

(12) United States Patent
Kawabe et al.

(10) Patent No.: US 6,396,212 B2
(45) Date of Patent: May 28, 2002

(54) APPARATUS AND METHOD FOR DISCHARGE TREATMENT

(75) Inventors: Masaaki Kawabe; Genya Anan, both of Ibaraki (JP)

(73) Assignee: Japan Vilene Company, Tokyo (JP)

( * ) Notice: Subject to any disclaimer, the term of this patent is extended or adjusted under 35 U.S.C. 154(b) by 0 days.

(21) Appl. No.: 09/766,117

(22) Filed: Jan. 19, 2001

(30) Foreign Application Priority Data

Jan. 19, 2000 (JP) ..... 2000-010977

(51) Int. Cl.[7] ..... H01J 1/00
(52) U.S. Cl. ..... 315/111.01; 315/111.21
(58) Field of Search ..... 315/111.21, 111.01, 315/111.81; 313/231.31, 231.41, 231.51

(56) References Cited

U.S. PATENT DOCUMENTS 5,414,324 A * 5/1995 Roth et al. ..... 315/111.21

* cited by examiner

*Primary Examiner*—David Vu
(74) *Attorney, Agent, or Firm*—Darby & Darby

(57) ABSTRACT

An apparatus for a discharge treatment, comprising a pair of electrodes located opposite to each other;

an element for applying an alternating current-high voltage between the electrodes; and an element for passing a gas mainly composed of air at a rate of 10 m/sec or more through a space formed between the electrodes is disclosed. Further, a process for a discharge treatment of an article, comprising applying an alternating current-high voltage between a pair of electrodes located opposite to each other, to the article placed between the electrodes, while a gas mainly composed of air is passed at a rate of 10 m/sec or more through a space formed between the electrodes, to thereby expose the article to an electric discharge induced between the electrodes, is also disclosed.

6 Claims, 5 Drawing Sheets

APPARATUS AND METHOD FOR DISCHARGE TREATMENT

BACKGROUND OF THE INVENTION

1. Field of the Invention

The present invention relates to an apparatus for a discharge treatment and a method for the discharge treatment.

2. Description of the Related Art

In a corona discharge treatment, an electric discharge is induced by applying an AC (alternating current)-high voltage between paired electrodes, composed of a roll or plane standard electrode and a corona electrode spaced opposite thereto, and an article placed between the paired electrodes is treated with the electric discharge. However, the corona discharge treatment has the following defects:

(a) In some cases an article may be damaged by repeated discharge treatments. For example, an article made of a thermoplastic resin may be melted. Such a melting occurs when an AC-high voltage having a high-frequency is applied.

(b) When the AC-high voltage applied is a sinusoidal wave, the resultant electric discharge might be concentrated, and thus, an article treated could be badly damaged, for example, pinholes could be produced therein.

Further, if the corona discharge treatment is industrially utilized, the ability to conduct a high-speed discharge treatment is required. Conceivably, a method for a high-speed discharge treatment can be realized by increasing the discharging energy density per unit area of an electrode. Nevertheless, even under usual conditions, a treated article may be damaged, for example, melted, or pinholes may be produced, as mentioned above. It is difficult to carry out the corona discharge treatment under the high density of the discharging energy, as the conditions occur under which the article is easily melted or pinholes are easily produced.

Furthermore, it is known that the surface of an article can be roughened by the corona discharge treatment, but a roughening treatment which can be industrially utilized is not known.

SUMMARY OF THE INVENTION

The inventors of the present invention made an intensive investigation into a solution to the above problems, and as a result found that, by passing gas at a rate of 10 m/sec or more through a space formed between a pair of electrodes, the temperature of the article to be treated, and ambient temperature, can be lowered, the electric discharge can be homogenized, i.e., the concentration of the electric discharge can be reduced, an increase of the discharge energy density does not damage the article to be treated, a high-speed discharge treatment can be stably carried out, and the article surface can be roughened under a high density of the discharging energy. Further, the inventors also found that, because the density of the discharging energy can be raised, a means for inducing an electric discharge can be miniaturized.

The present invention is based on the above findings.

Accordingly, the object of the present invention is to provide a discharge treatment apparatus and a discharge treatment method which enable a high-speed discharge treatment and roughening treatment without damaging the article.

Other objects and advantages will be apparent from the following description.

In accordance with the present invention, there is provided an apparatus for a discharge treatment, comprising a pair of electrodes located opposite to each other;

a means for applying an alternating current-high voltage between the electrodes; and a means for passing a gas mainly composed of air at a rate of 10 m/sec or more through a space formed between the electrodes.

A preferable apparatus of the present invention has a means for applying the alternating current-high voltage having a pulse wave pattern between the electrodes.

Another preferable apparatus of the present invention has a means for passing a gas mainly composed of air at a rate of 85 m/sec or more through the space formed between the electrodes.

In accordance with the present invention, there is also provided a process for a discharge treatment of an article, comprising applying an alternating current-high voltage between a pair of electrodes located opposite to each other, to the article placed between the electrodes, while a gas mainly composed of air is passed at a rate of 10 m/sec or more through a space formed between the electrodes, to thereby expose the article to an electric discharge induced between the electrodes.

In a preferable process of the present invention, the alternating current-high voltage applied is a pulse wave.

In another preferable process of the present invention, the gas mainly composed of air is passed at a rate of 85 m/sec or more through the space formed between the electrodes.

DESCRIPTION OF THE PREFERRED EMBODIMENTS

The discharge treatment apparatus according to the present invention will be explained in detail hereinafter, with the assistance of the drawings.

Figure 1:
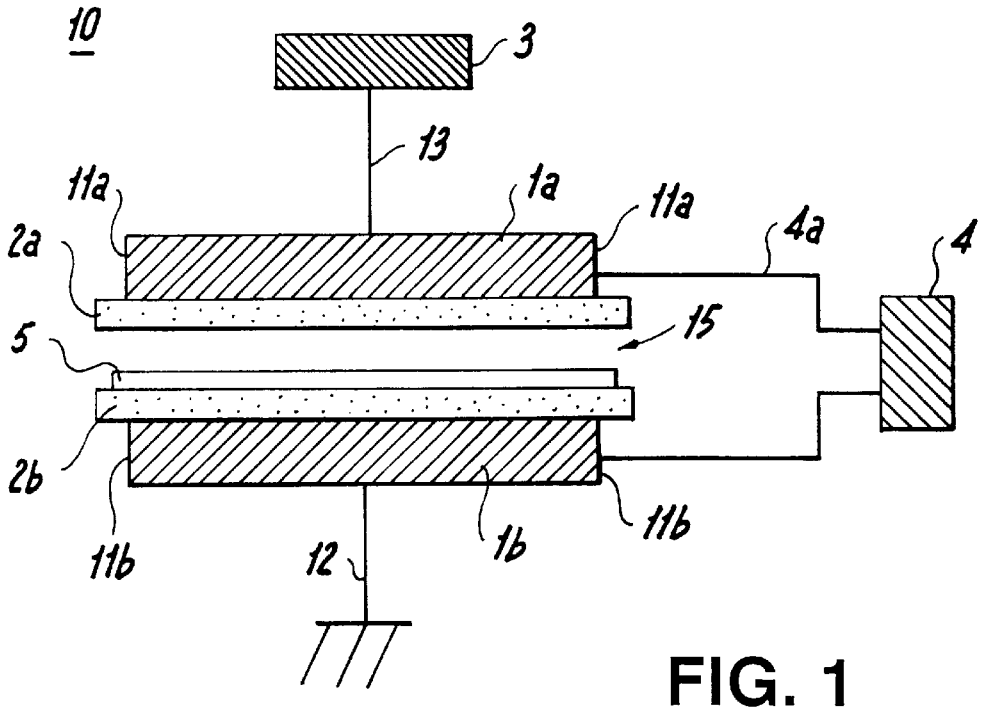
FIG. 1 is a sectional view schematically illustrating an embodiment of the discharge treatment apparatus according to the present invention.

In the discharge treatment apparatus 10 of the present invention shown in FIG. 1, a plane electrode 1*a* is spaced a predetermined distance from a plane electrode 1*b*, namely, plane electrodes 1*a*, 1*b* are located opposite to each other. The electrode 1*a* carries a dielectric layer 2*a* on a surface facing the other electrode 1*b*, and the electrode 1*b* carries a dielectric layer 2*b* on a surface facing the other electrode 1*a*. An article 5 to be treated is placed in a treating space 15 formed between the dielectric layers 2*a*, 2*b*. The article 5 can be placed in any manner in the treating space 15, so long as the gas stream can pass through the treating space 15. For example, the article 5 can be mounted on one dielectric layer 2*b* as shown in FIG. 1; the article 5 can be placed between the dielectric layers 2*a*, 2*b* without coming into contact with either of the layers 2*a*, 2*b*; the article 5 can be placed so that a whole surface of one side of the article 5 is brought into contact with the other dielectric layer 2*a*; or the article 5 can be placed so that a part of the article 5 comes into contact with the dielectric layers 2*a* and/or 2*b*.

One plane electrode 1*a* is connected to an AC-high voltage supply 3 via a lead wire 13, and the other plane electrode 1*b* is grounded via an earth wire 12, whereby an AC-high voltage can be applied between the electrodes 1*a*, 1*b*. The discharge treatment apparatus 10 further contains a gas-ejecting apparatus 4 which can pass a gas mainly composed of air at a rate of 10 m/sec or more through the space formed between the electrodes 1*a*, 1*b*. The gas-ejecting apparatus 4 may be optionally equipped with a gas duct 4*a*, to guide the gas.

The material of the electrodes, such as the plane electrodes 1*a*, 1*b*, which may be used in the present invention is not limited, but is preferably an electrically conductive material having a specific electric resistance of $10^3$ Ω·cm or less, more preferably $10^0$ Ω·cm or less. Examples of the usable materials are a metal, such as stainless steel, aluminum or tungsten, or an electrically conductive metal oxide, carbon, or an electrically conductive rubber, such as a composite rubber prepared from an electrical conductor (such as powdered metal or powdered carbon) and rubber.

When each of the plane electrodes 1*a*, 1*b* has a curved surface from a peripheral portion in a surface facing the other electrode to a sidewall 11*a*, 11*b*, an electric field is not usually concentrated between each of the sidewalls 11*a*, 11*b* of the plane electrodes 1*a*, 1*b*, and each of the dielectric layers 2*a*, 2*b*, and thus, damage to the dielectric layers 2*a*, 2*b* can be prevented.

A spark liable to occur between the plane electrodes 1*a*, 1*b* may be prevented if the size of the dielectric layers 2*a*, 2*b* on the plane electrodes 1*a*, 1*b* is larger than that of the plane electrodes 1*a*, 1*b*, and in addition, each of the dielectric layers 2*a*, 2*b* covers the portion from the periphery in a surface facing the other electrode to the sidewall 11*a*, 11*b*.

In the present apparatus 10, the discharge treatment can be conducted in a space sandwiched between the paired plane electrodes 1*a*, 1*b*, and thus, only a desired portion thereof can be treated. For example, when a combination of a plane electrode and an electrode having a lattice pattern is used, the article is treated only at a portion sandwiched by the plane electrode and the lattice electrode, namely, in the lattice pattern corresponding to the lattice electrode.

The dielectric layers 2*a*, 2*b* are preferably non-porous as a whole, but may contain a porous portion. If a dielectric layer contains a porous portion through in the direction of the thickness, a spark discharge may occur in the porous portion. Therefore, the use of a dielectric layer without a porous portion, which is continuous from an obverse side (a surface facing the article) to the reverse side (a surface in contact with the electrode), is preferable.

Dielectric materials usable for the dielectric layers 2*a*, 2*b* are not particularly limited, so long as the materials are insulators. Examples of the dielectric materials which may be used are glass (such as quartz), ceramic (such as alumina, zirconia, titania, or strontium titanate), rubber (such as synthetic rubber, such as silicone rubber, chloroprene rubber, butadiene rubber, or natural rubber), or thermoplastic resin (such as polytetrafluoroethylene, or polyester). It is preferable to use glass or ceramic. In particular, silica glass, alumina or zirconia are more preferable, because of a better resistance thereof to a high voltage. The thickness of the dielectric layer may vary with a resistance to dielectric breakdown, a specific dielectric constant or the like, and is not particularly limited, but is preferably about 0.05 mm to 200 mm.

Each of the electrodes 1*a*, 1*b* shown in FIG. 1 carries the dielectric layers 2*a*, 2*b*, respectively. A combination of an electrode with a dielectric layer, and the other electrode without a dielectric layer maybe used. Further, if an insulating film is treated as the article, the film per se acts as a dielectric material. Therefore, both of the electrodes do not necessarily carry the dielectric layers. When the AC-high voltage applied is a wave such as a sinusoidal wave which does not show a steep rising slope, both of the electrodes having the dielectric layers are preferably used.

In the present apparatus, the paired electrodes are located opposite to each other, and separated from each other at a predetermined interval. The interval may vary with the thickness of the article to be treated. When the article is treated under a condition such that it comes into contact with one of the surfaces of the electrode, or the surface of the dielectric layer if applicable, an interval between the other surface of the article (i.e., non-contacted surface) and the electrode surface or the dielectric layer surface facing the article is preferably 5 mm or less, more preferably 1 mm or less. The lower limit of the interval is preferably 5 μm or more. When the article is treated without coming into contact with both of the surfaces of the electrodes or the dielectric layers, a sum of an interval between one surface of the article and the electrode surface or the dielectric layer surface facing the article, and the other interval between the other surface of the article and the other electrode surface or the other dielectric layer surface facing the article is preferably 5 mm or less, more preferably 1 mm or less. The lower limit of the sum is preferably 5 μm or more. In this case, each of the intervals between the surface of the article and the electrode surface or the dielectric layer surface may be almost the same as, or different from, the other.

In the apparatus 10 shown in FIG. 1, the plane electrode 1*a* is connected to the AC-high voltage supply 3 via a lead wire 13, and the other plane electrode 1*b* is grounded via an earth wire 12. Conversely, the plane electrode 1*a* may be grounded, and the other plane electrode 1*b* may be connected to the AC-high voltage supply 3.

Figure 4:
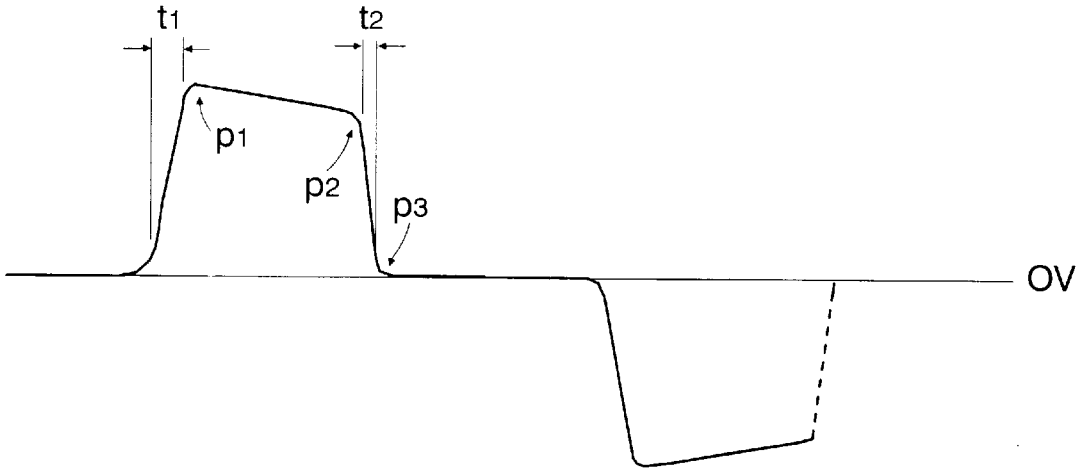
FIG. 4 illustrates an example of a pulse wave pattern.
Figure 5:
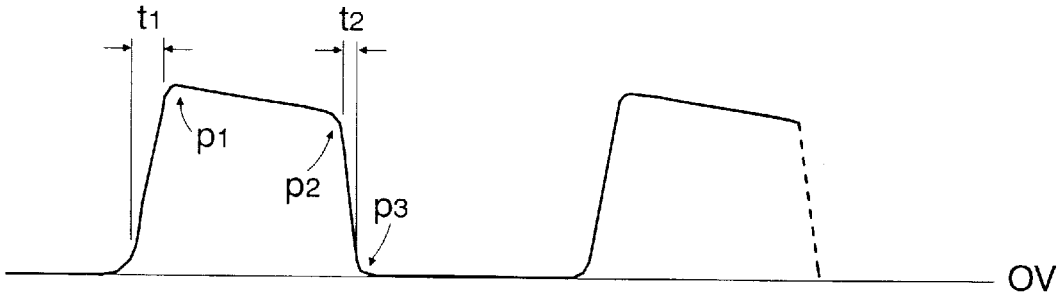
FIG. 5 illustrates another example of a pulse wave pattern.

The wave-shape of the voltage applied between the paired electrodes is not particularly limited, but, for example, is a sinusoidal wave, a pulse wave, a rectangular wave, or the like. The pulse wave is preferable, because an electric discharge produced thereby can be homogenized. In the case of the pulse wave, a voltage wave rising time and falling time are preferably 2 microseconds or less, more preferably 0.5 microsecond or less, most preferably 0.2 microsecond or less. The term "voltage wave rising time" as used herein means the time period (t1 in FIGS. 4 and 5) wherein the voltage reaches 90% of a first peak voltage (p1 in FIGS. 4 and 5) from 10% of the first peak voltage. The term "voltage wave falling time" as used herein means the time period (t2 in FIGS. 4 and 5) wherein the voltage reaches 90% of an opposite peak voltage (p3 in FIGS. 4 and 5) formed in a direction opposite to that of the first peak voltage p1 from 10% of the opposite peak voltage p3 with respect to a reference voltage (p2 in FIGS. 4 and 5) which is elevated by the first peak voltage p1.

The pulse voltage may be generated, for example, by instantaneously connecting a voltage stored in a condenser to a load through a spark switch, by switching a high voltage directly using semiconductor switches connected in series; or by increasing a pulse voltage modulated by a semiconductor switch, through a transformer. Use of a magnetic switch makes it possible to shorten the rising and falling times.

The polarity of the voltage applied is not particularly limited. It is possible to use a monopolar voltage or a bi-polar voltage, but the bi-polar voltage is preferable because of a resultant high efficiency of the treatment.

The voltage to be applied in the present apparatus varies with the distance between the electrodes (distance including the thickness of the dielectric layer or layers, if applicable), an atmosphere around the electrodes or the like, and thus, there is no particular limit thereto, but the voltage to be applied is preferably 2 KVp or more, more preferably 5 KVp or more, as this allows the electric discharge to be easily induced. Further, the upper limit of the voltage applied is not particularly limited, so long as the article is not damaged, but is preferably about 100 KVp. The term "KVp" means a voltage difference between a maximum peak and 0 of a voltage. An electric field strength is not particularly limited, so long as the article or the dielectric layers are not damaged, but is preferably 10 KVp/cm to 500 KVp/cm, more preferably 20 KVp/cm to 300 KVp/cm. The term "electric field strength" means a quotient or value obtained by dividing a voltage applied to electrodes by a distance between electrodes (distance including the thickness of the dielectric layer or layers, if applicable).

A frequency of the voltage applied is preferably 1 KHz to 500 KHz, more preferably 10 KHz to 200 KHz. If the frequency is less than 1 KHz, a treatment must be carried out for a long time. If the frequency is more than 500 KHz, the article and the dielectric layers may be overheated by dielectric heating, and thus destroyed.

A power applied is preferably 2.5 $W/cm^2$ or more, more preferably 5 $W/cm^2$ or more. The upper limit of the power applied may vary with the rate or amount of the gas stream or the like, and is not particularly limited. The power applied can be determined from a Lissajous figure of the power applied and a discharged charge.

The AC-high voltage may be applied continuously or intermittently. When the voltage is intermittently applied, the repetition number per second is preferably within the scope of the frequency as above. That is, the repetition number per second is preferably 1,000 to 500,000 times, more preferably 10,000 to 200,000 times.

As the means for passing the gas mainly composed of air at a rate of 10 m/sec or more through the space formed between the electrodes, a gas-suction apparatus may be used instead of or in addition to the gas-ejecting apparatus 4 as shown in FIG. 1. If the rate is less than 10 m/sec, effects used to cool the article and the atmosphere in the discharge-treating space, and to homogenize the electric discharge may be reduced. The rate is preferably 85 m/sec or more, more preferably 100 m/sec or more. The upper limit of the rate of the gas stream is not particularly limited, but may vary with the structure of the discharge treatment apparatus, the power applied, and the desired degree of the discharge treatment.

When the wave-shape of the AC-high voltage is a sinusoidal wave, the rate of the gas stream is preferably 85 m/sec or more, more preferably 100 m/sec. When the wave-shape of the AC-high voltage is a pulse wave, the passing rate of the gas stream at 10 m/sec or more is sufficient. It is preferable to raise the rate of the gas stream in accordance with an increase of the power applied, independently of the wave-shape of the AC-high voltage.

The passing rate of the gas stream in the present specification means a quotient or value (unit=m/sec) obtained by dividing an amount (unit=$m^3$/sec) of a gas of 1 atmospheric pressure passing through the space formed between a pair of the electrodes by a sectional area (unit=$m^2$) at a section crossing at right angles to the direction of the gas stream in the space formed between a pair of the electrodes. When the sectional area of the space formed between a pair of the electrodes is not constant, the passing rate of the gas stream is obtained by dividing the gas amount by the minimum sectional area.

The gas passing through the space formed between a pair of the electrodes may be cooled. When the gas is cooled, however, it is preferable not to liquefy the gas. For example, when air is cooled, it is preferable not to produce droplets, or if droplets are formed, it is preferable to remove them.

The gas passing through the space formed between a pair of the electrodes is not particularly limited, so long as it is mainly composed of air. The gas mainly composed of air means a gas comprising air in an amount of 20% by volume or more, preferably 50% by volume or more, with respect to a volume of a whole gas. A preferable gas mainly composed of air is air per se. A gas which may be used in combination with air is, for example, a gas (such as a rare gas or nitrogen gas) for stabilizing an electric discharge, or a reactive gas for introducing one or more functional groups.

As the rare gas, for example, helium, neon, argon, krypton, xenon, or radon maybe used. The reactive gas is not particularly limited, so long as it can introduce one or more desired functional groups. The reactive gas may be, for example, gas of an oxygen-containing compound, a nitrogen-containing compound, a sulfur-containing compound, or a phosphorus-containing compound, or the like. The reactive gas as above may be used alone or in a combination thereof. Further, the gas used in the present invention may contain one or more gases of an organic compound, such as an alcohol, ketone, or the like.

It is preferable to use the gas of the oxygen-containing compound, and/or the sulfur-containing compound, to impart hydrophilic properties to the article. As the oxygen-containing compound gas, for example, an oxygen gas, air, carbon dioxide gas, or carbon monoxide gas maybe used. As the sulfur-containing compound gas, for example, hydrogen sulfide ($H_2S$), sulfur monoxide (SO), sulfur dioxide ($SO_2$), sulfur trioxide ($SO_3$), disulfur trioxide ($S_2O_3$), or sulfur heptoxide ($S_2O_7$) gas may be used.

Although not shown in FIG. 1, the discharge treatment apparatus of the present invention may be equipped with a means (for example, a pair of rolls) for conveying the article into or out of the space formed between a pair of the electrodes. The article may be continuously treated with the electric discharge, using the apparatus equipped with such a conveying means.

Figure 2:
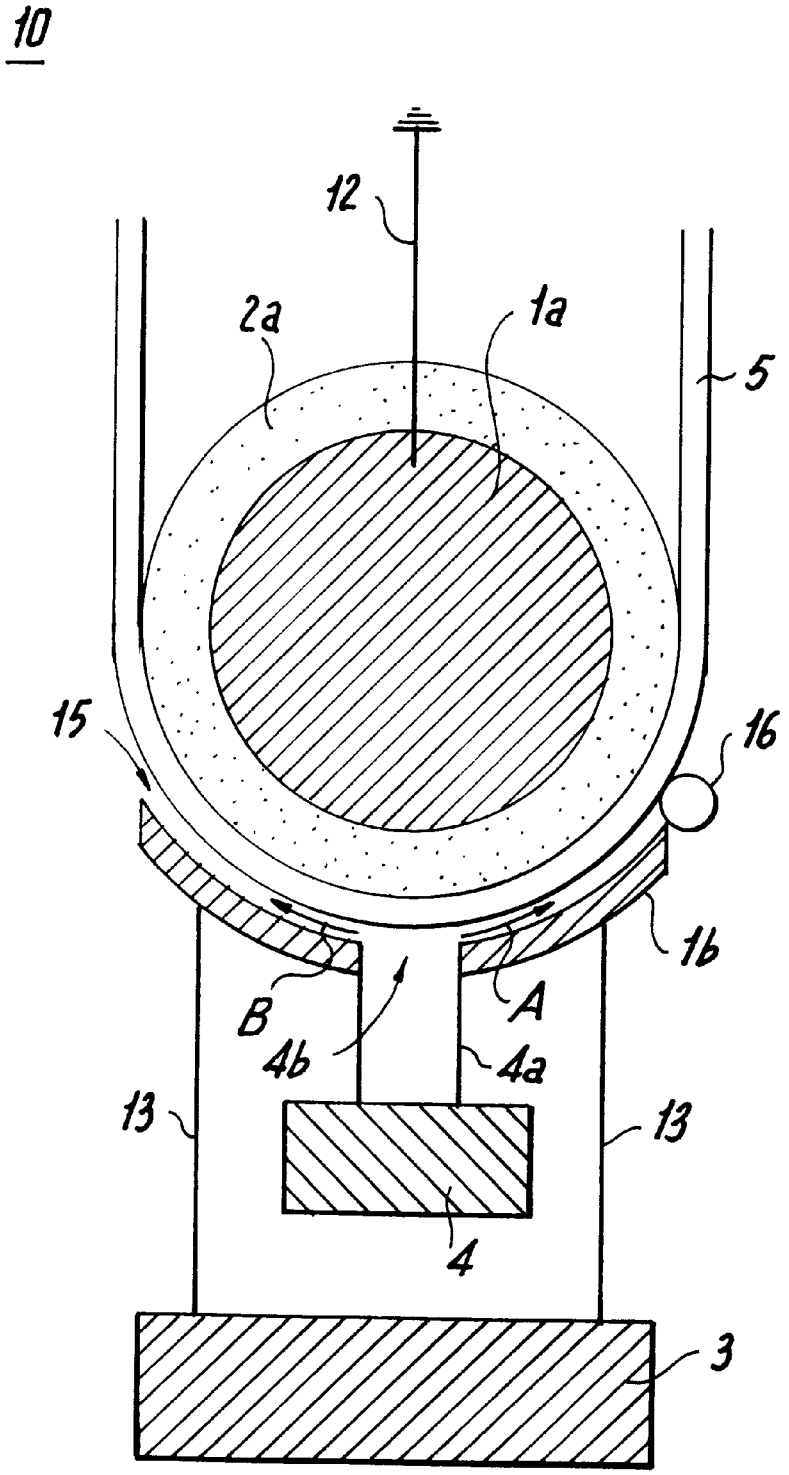
FIG. 2 is a sectional view schematically illustrating another embodiment of the discharge treatment apparatus according to the present invention.

Another embodiment of the discharge treatment apparatus according to the present invention is shown in FIG. 2. In the discharge treatment apparatus 10 as shown in FIG. 2, a cylindrical electrode 1*a* carries a hollow-cylindrical dielectric layer 2*a* on a sidewall thereof. The cylindrical electrode 1*a* is located opposite to concavely curved electrodes 1*b* without a dielectric layer and separated therefrom at a predetermined interval. The concave curves of the electrodes 1*b* correspond to the convex surface of the hollow-cylindrical dielectric layer 2*a* on the cylindrical electrode 1*a*. A treating space 15 is formed between the convexly curved surface of the dielectric layer 2*a* and the concavely curved surfaces of the electrodes 1*b*. The article 5 to be treated may be supplied into the treating space 15. The cylindrical electrode 1*a* is grounded via an earth wire 12, and the concavely curved electrodes 1*b* are connected to an AC-high voltage supply 3 via lead wires 13, whereby an AC-high voltage can be applied to the paired electrodes 1*a* 1*b*. The discharge treatment apparatus 10 further contains a gas-ejecting apparatus 4 which can pass gas mainly composed of air at a rate of 10 m/sec or more through the treating space 15 formed between the electrodes. The gas-ejecting apparatus 4 is connected via a gas duct 4*a* to the treating space 15 at an opening 4*b* formed at a center of the concavely curved electrode 1*b*. A gas-suction apparatus maybe used instead of or in addition to the gas-ejecting apparatus 4.

As above, the shape of the electrode is not particularly limited. Further, a combination of the electrodes is not particularly limited. For example, a combination of plane electrodes as shown in FIG. 1, a combination of a cylindrical electrode and a correspondingly concavely curved electrode as shown in FIG. 2, a combination of a convexly spherical electrode and a correspondingly concavely spherical electrode, or the like may be used. When the combination of the cylindrical electrode 1*a* and the concavely curved electrodes 1*b* as shown in FIG. 2 is used, the article may be continuously treated under stable supply conditions.

The dielectric layer may be provided only on the cylindrical electrode 1*a* as shown in FIG. 2, only on the concavely curved electrode 1*b*, or on both of the electrodes 1*a*, 1*b*. Further, if an insulating film is treated as the article, the film per se acts as a dielectric material. Therefore, both of the electrodes do not necessarily carry the dielectric layers.

The direction of the gas stream is not particularly limited. For example, the gas stream may be ejected or sucked in a direction parallel to the electrode surfaces as shown in FIG. 1, or perpendicular to the electrode surface as shown in FIG. 2, to generate the gas stream in a direction parallel to the electrode surfaces, that is, the directions as shown by arrows A, B in FIG. 2, or opposite directions thereof. Further, the gas stream may be ejected or sucked in a direction other than parallel and perpendicular directions to the electrode surfaces to generate the gas stream in a direction parallel to the electrode surfaces.

When the gas is ejected or sucked in the direction perpendicular to the cylindrical electrode 1*a* as shown in FIG. 2, the gas stream is generated in the direction parallel to the electrode surfaces, that is, the directions as shown by the arrows A, B in FIG. 2, or opposite directions thereof. In this case, a roll 16 may be placed at one of the edges of a pair of the electrodes, to close one of the edges and thus occlude the gas stream. This closing of one of the edges can reduce an amount of the gas stream by half, if the rate of the gas stream is not changed. In this case, the gas does not flow to the closed edge of the electrodes, and thus, the article or the atmosphere cannot be cooled, and the electric discharge cannot be homogenized in this area. Therefore, it is preferable not to apply the AC-high voltage for inducing the electric discharge in the treating space 15 on the side having the closed edge.

The discharge treatment apparatus 10 as shown in FIG. 2 is the same as the apparatus as shown in FIG. 1, except that the shapes of the electrodes are different, the dielectric layer is carried only on one electrode, the direction of the gas stream is changed, and one of the edges of the electrodes may be closed.

Figure 3:
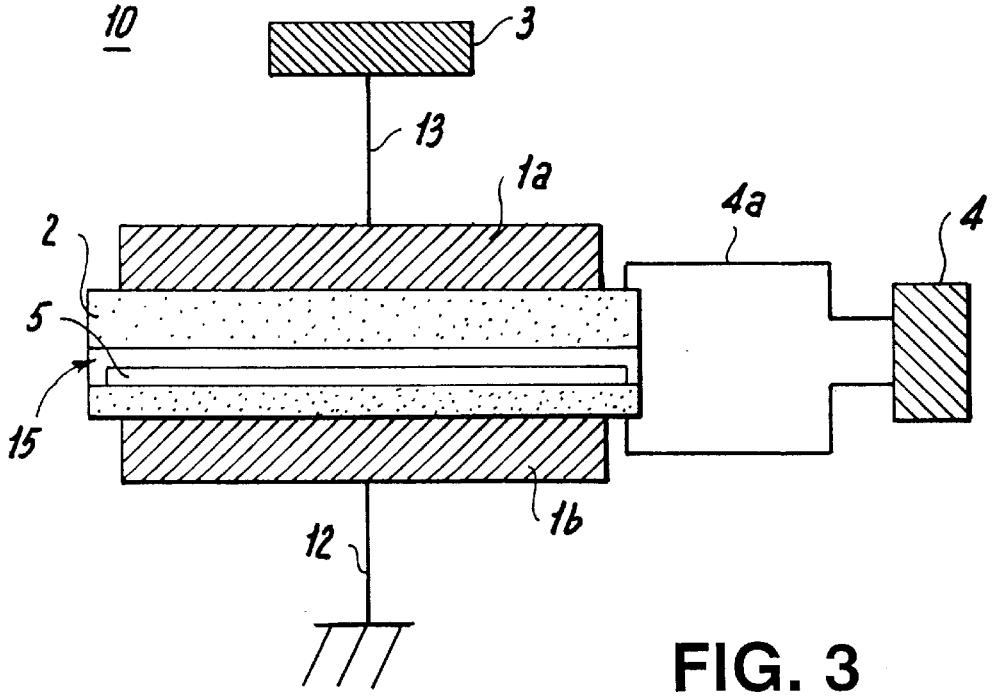
FIG. 3 is a sectional view schematically illustrating still another embodiment of the discharge treatment apparatus according to the present invention.

Still another embodiment of the discharge treatment apparatus according to the present invention is shown in FIG. 3. In the discharge treatment apparatus 10 as shown in FIG. 3, a pair of the plane electrodes 1*a*, 1*b* are located opposite to each other, and separated at a predetermined distance from each other. The dielectric layer 2 is placed between the paired electrodes 1*a*, 1*b* so that both sides of the dielectric layer 2 come into contact with the plane electrodes 1*a*, 1*b*, respectively. An external shape of the dielectric layer 2 is a rectangular parallelepiped. The dielectric layer 2 has a through-hole treating space 15 which pierces through the dielectric layer 2, and the hollow portion of the through-hole treating space 15 is a rectangular parallelepiped. That is, the discharge treatment apparatus 10 shown in FIG. 3 the dielectric layer 2 contains the through-hole treating space 15 therein, and the article 5 can be placed in the through-hole treating space 15. The plane electrode 1*a* is connected to the AC-high voltage supply 3 via a lead wire 13, and the other plane electrode 1*b* is grounded via an earth wire 12, whereby an AC-high voltage can be applied to the paired plane electrodes 1*a*, 1*b*. The discharge treatment apparatus 10 further contains a gas-ejecting apparatus 4 which can pass a gas mainly composed of air at a rate of 10 m/sec or more through the through-hole treating space 15 formed in the dielectric layer 2, via a gas duct 4*a*. A gas-suction apparatus maybe used instead of or in addition to the gas-ejecting apparatus 4.

As shown in FIG. 3, the dielectric layer is not necessarily carried on the electrodes, that is, the dielectric layer may be independent from the electrodes. When a cylindrical or rectangular parallelepiped dielectric layer contains a through-hole treating space 15, the gas stream generated by the gas-ejecting apparatus or the gas-suction apparatus does not disperse, but effectively passes through the paired electrodes.

Although not shown in FIG. 3, the discharge treatment apparatus 10 may be equipped with a means (for example, a pair of rolls) for conveying the article into or out of the through-hole treating space 15. The article may be continuously treated with the electric discharge, using the apparatus equipped with such a conveying means.

The discharge treatment apparatus 10 as shown in FIG. 3 is the same as the apparatus as shown in FIG. 1, except that the external shape of the dielectric layer is rectangular parallelepiped, and the dielectric layer contains the through-hole treating space 15. In the discharge treatment apparatus 10 as shown in FIG. 3, the dielectric layer 5 may be spaced from one or both of the paired electrodes 1*a*, 1*b* by inserting one or more spacers between one or both of the surfaces of the dielectric layer 5 and one or both of the surfaces of the paired electrodes 1*a*, 1*b*. In this embodiment of the discharge treatment apparatus, the article may be treated as in the apparatus 10 as shown in FIG. 3.

A process for a discharge treatment of the present invention may be carried out, using the discharge treatment apparatus of the present invention as above. That is, the present process comprises applying an alternating current-high voltage between a pair of electrodes located opposite to each other, to the article placed between the electrodes, while a gas mainly composed of air is passed at a rate of 10 m/sec or more through the space formed between the electrodes, to thereby expose the article to an electric discharge induced between the electrodes.

The article which may be treated by the present process is not particularly limited, but is, for example, a fibrous sheet, such as a woven fabric, knitted fabric, non-woven fabric or a composite thereof, or a microporous film, foam, film, fiber, or a molded article made of resin. The article may be made of an inorganic and/or organic material. According to the present process, the article made of an organic material can be treated at a high speed without damage, or the surface thereof can be roughened.

The article can be placed between the paired electrodes in any manner, as mentioned with respect to the present apparatus, and the AC-high voltage is then applied between the paired electrodes. As mentioned with respect to the present apparatus, the wave-shape of the voltage applied in the present process is not particularly limited, but, for example, is a sinusoidal wave, a pulse wave, a rectangular wave, or the like. The pulse wave is preferable. In the case of the pulse wave, a voltage wave rising time and falling time are preferably 2 microseconds or less, more preferably 0.5 microsecond or less, most preferably 0.2 microsecond or less. The polarity of the voltage applied is not particularly limited. It is possible to use a monopolar voltage or a bi-polar voltage, but the bi-polar voltage is preferable.

The voltage to be applied in the present process is not particularly limited, as mentioned with respect to the present apparatus, but the voltage to be applied is preferably 2 KVp or more, more preferably 5 KVp or more. Further, the upper limit of the voltage applied is not particularly limited, but preferably is about 100 KVp. An electric field strength is not particularly limited, but preferably is 10 KVp/cm to 500 KVp/cm, more preferably 20 KVp/cm to 300 KVp/cm.

As mentioned with respect to the present apparatus, a frequency of the voltage applied is preferably 1 KHz to 500 KHz, more preferably 10 KHz to 200 KHz, and a power applied is preferably 2.5 W/cm$^2$ or more, more preferably 5 W/cm$^2$ or more. The upper limit of the power applied is not particularly limited. The AC-high voltage maybe applied continuously or intermittently. When the voltage is intermittently applied, the repetition number per second is preferably 1,000 to 500,000 times, more preferably 10,000 to 200,000 times.

A treating time may vary with the kind of article, the rate of the gas stream, power applied, or the like, and thus is not particularly limited. In general, the treating time is substantially 0.1 second or less for a film as the article, or substantially 1 second or less for a non-woven fabric as the article.

The gas is passed through the space formed between the paired electrodes, i.e., two spaces formed between the article and the electrodes (or the dielectric layer or layers, if applicable), when the article is not in contact with both of the electrodes (or the dielectric layer or layers, if applicable), or a space formed between the article and the electrode (or the dielectric layer, if applicable), when the article is in contact with only one electrode (or the dielectric layer, if applicable). As mentioned with respect to the present apparatus, the gas is passed at a rate of 10 m/sec or more, preferably 85 m/sec or more, more preferably 100 m/sec or more. The upper limit of the rate of the gas stream is not particularly limited, but is preferably about 1,000 m/sec. When the wave-shape of the AC-high voltage is a sinusoidal wave, the rate of the gas stream is preferably 85 m/sec or more, more preferably 100 m/sec. When the wave-shape of the AC-high voltage is a pulse wave, the passing rate of the gas stream at 10 m/sec or more is sufficient. It is preferable to raise the rate of the gas stream in accordance with an increase of the power applied, independently of the wave-shape of the AC-high voltage.

The gas passing through the space formed between the paired electrodes may be cooled. When the gas is cooled, however, it is preferable not to liquefy the gas. For example, when air is cooled, it is preferable not to produce droplets, or if droplets are formed, it is preferable to remove them.

The gas passing through the space formed between the paired electrodes is not particularly limited, so long as it is mainly composed of air. A preferable gas is air per se. A gas which may be used in combination with air is mentioned with respect to the present apparatus.

The discharge treatment process of the present invention has an advantage in that the electric discharge maybe generated under an atmospheric pressure or more, and the electric discharge may be generated continuously. The present process may be carried out under an elevated or reduced pressure. Further, the pressure may be changed or not changed, or the pressure may be changed continuously or discontinuously.

EXAMPLES

The present invention will now be further illustrated by, but is by no means limited to, the following Examples.

Example 1

A polyester film (thickness=100 $\mu$m) was used as the article 5 to be treated.

An apparatus the same as that shown in FIG. 1, except that the electrode 1*b* did not carry a dielectric layer, was used in this Example. More particularly, the apparatus comprised a pair of electrodes 1*a*, 1*b* composed of a plane aluminum electrode 1*a* carrying a non-porous alumina dielectric layer 2*a* (thickness=2 mm), and a plane aluminum electrode 1*b* without a dielectric layer, an AC-high voltage supply 3 connected to the plane aluminum electrode 1*a* via a lead wire 13, an earth wire 12 connected to the plane aluminum electrode 1*b*, a gas-ejecting apparatus 4 which can eject a gas stream in a direction parallel to the surfaces of the paired electrodes 1*a*, 1*b*, and a gas duct 4*a*. The paired electrodes 1*a*, 1*b* were located opposite to each other and spaced at 0.5 mm from each other (this was the distance from the surface of the alumina dielectric layer 2*a* to the surface facing thereto of the plane aluminum electrode 1*b*).

Then, the polyester film was mounted on the aluminum electrode 1*b* in the discharge treatment apparatus. The polyester film was treated by passing an air stream (temperature=20° C.) between the paired electrodes 1*a*, 1*b* at a rate of approximately 70 m/sec under a constant pressure of 1 atmospheric pressure measured at a gas stream-exit of treating space 15, while an AC-high voltage (bi-polar; a sinusoidal wave; frequency=about 50 kHz; voltage applied= about 9.5 kvp; power applied=8 W/cm$^2$) was applied from the supply 3 for 0.5 second to generate an electric discharge.

The polyester film before the discharge treatment was dipped in and then taken out of water. The film repelled water and water droplets were formed on the surface. After the discharge treatment, the polyester film was dipped in and then taken out of water. Water spread on the surface of the treated polyester film, and no water droplets were formed on the surface. The treated polyester film shrank in comparison with the untreated film.

Example 2

The polyester film as used in Example 1 was treated by repeating the procedures as described in Example 1 except that (1) the rate of the air stream was about 100 m/sec, (2) the power applied was 10 W/cm$^2$, and (3) the time for applying the AC-high voltage was about 0.1 second.

The polyester film before the discharge treatment was dipped in and then taken out of water. The film repelled water and water droplets were formed on the surface. After the discharge treatment, the polyester film was dipped in and then taken out of water. Water spread on the surface of the treated polyester film, and no water droplets were formed on the surface. The treated polyester film did not shrink in comparison with the untreated film.

Example 3

The polyester film as used in Example 1 was treated by repeating the procedures as described in Example 1 except that the time for applying the AC-high voltage was about 2 seconds.

The polyester film before the discharge treatment was dipped in and then taken out of water. The film repelled water and water droplets were formed on the surface. After the discharge treatment, the polyester film was dipped in and then taken out of water. Water spread on the surface of the treated polyester film, and no water droplets were formed on the surface. The treated polyester film shrank in comparison with the untreated film. The degree of the shrinkage was larger than that of the treated film of Example 1.

Figure 6:
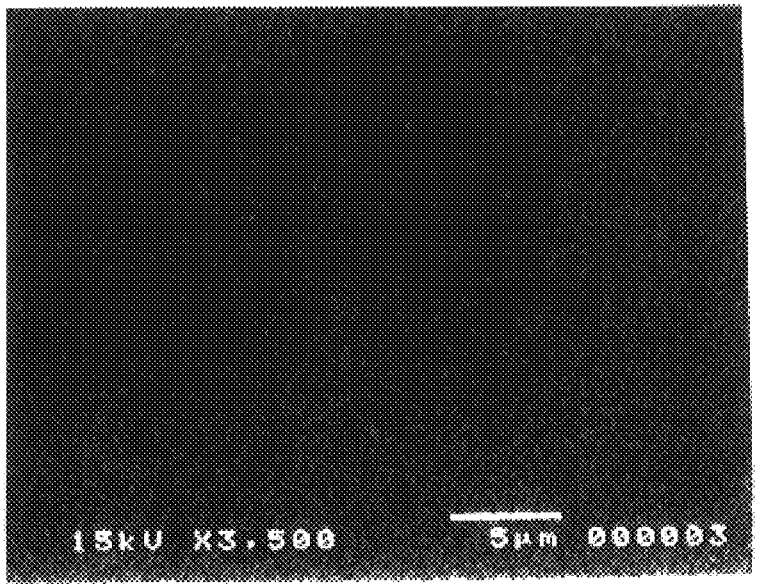
FIG. 6 is an electron micrograph of a polyester film surface before a discharge treatment of Example 3.
Figure 7:
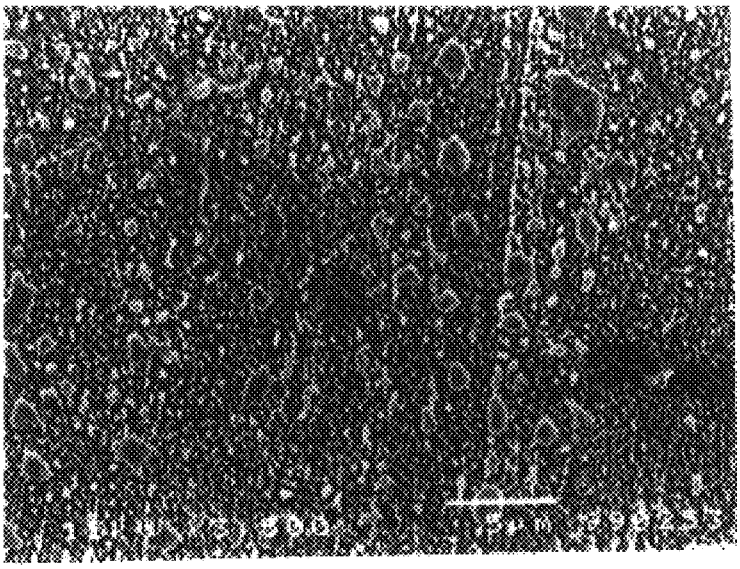
FIG. 7 is an electron micrograph of a polyester film surface after the discharge treatment of Example 3.

The polyester film surface before the discharge treatment is shown in an electron micrograph of FIG. 6, whereas the polyester film surface after the discharge treatment is shown in an electron micrograph of FIG. 7. As apparent from FIGS. 6 and 7, an uneven structure was formed on the treated surface. This means that a roughening treatment was carried out by the discharge treatment.

Example 4

The polyester film as used in Example 1 was treated by repeating the procedures as described in Example 1 except that (1) the rate of the air stream was about 150 m/sec, (2) the power applied was 13 W/cm$^2$, and (3) the time for applying the AC-high voltage was about 2 seconds.

The polyester film before the discharge treatment was dipped in and then taken out of water. The film repelled water and water droplets were formed on the surface. After the discharge treatment, the polyester film was dipped in and then taken out of water. Water spread on the surface of the treated polyester film, and no water droplets were formed on the surface. The treated polyester film did not shrink in comparison with the untreated film.

The polyester film surfaces before and after the discharge treatment were observed by an electron microscope, and it was found that an uneven structure was formed on the treated surface. Therefore, it is apparent that a roughening treatment was carried out by the discharge treatment.

Comparative Example 1

The polyester film as used in Example 1 was treated by repeating the procedures as described in Example 1 except that an air stream was not passed. The polyester film was melted and deformed.

Comparative Example 2

The polyester film as used in Example 1 was treated by repeating the procedures as described in Example 1 except that (1) an air stream was not passed, (2) the power applied was 1 W/cm$^2$, and (3) the time for applying the AC-high voltage was about 0.5 second.

The polyester film was not melted. The polyester films before and after the discharge treatment were dipped in and then taken out of water. The untreated and treated films repelled water and water droplets were partially formed on the surfaces.

Example 5

The article to be treated was a non-woven fabric (weight per unit area=75 g/m$^2$; thickness=about 0.2 mm) which was composed of polyethylene ultrafine fibers and polypropylene ultrafine fibers and was prepared by hydro-entangling a fiber web obtained from polyethylene/polypropylene 17-dividable fibers by a wet-laid method.

Then, the non-woven fabric was treated by repeating the procedures as described in Example 1, except that (1) the power applied was 6 W/cm$^2$, and (2) the time for applying the AC-high voltage was about 1.5 seconds.

When water was added dropwise, the untreated non-woven fabric showed practically no absorption of water droplets, whereas the treated non-woven fabric immediately absorbed water droplets. The treated non-woven fabric shrank slightly in comparison with the untreated non-woven fabric.

Example 6

The non-woven fabric as used in Example 5 was treated by repeating the procedures as described in Example 5, except that (1) the rate of the air stream was about 150 m/sec, (2) the power applied was 8 W/cm$^2$, and (3) the time for applying the AC-high voltage was about 1 second.

When water was added dropwise, the untreated non-woven fabric showed practically no absorption of water droplets, whereas the treated non-woven fabric immediately absorbed water droplets. The treated non-woven fabric did not shrink in comparison with the untreated non-woven fabric.

Example 7

The non-woven fabric as used in Example 5 was treated by repeating the procedures as described in Example 6, except that the rate of the air stream was 100 m/sec.

When water was added dropwise, the untreated non-woven fabric showed practically no absorption of water droplets, whereas the treated non-woven fabric immediately absorbed water droplets. The treated non-woven fabric did not shrink in comparison with the untreated non-woven fabric.

Example 8

The non-woven fabric as used in Example 5 was treated by repeating the procedures as described in Example 6, except that the rate of the air stream was 80 m/sec.

When water was added dropwise, the untreated non-woven fabric showed practically no absorption of water droplets, whereas the treated non-woven fabric immediately absorbed water droplets. Holes were produced in limited small portions of the treated non-woven fabric.

Comparative Example 3

The non-woven fabric as used in Example 5 was treated by repeating the procedures as described in Example 5, except that an air stream was not passed. The non-woven fabric was severely melted.

Comparative Example 4

The non-woven fabric as used in Example 5 was treated by repeating the procedures as described in Example 5, except that the rate of the air stream was about 8 m/sec. The non-woven fabric was melted.

Example 9

The non-woven fabric as used in Example 5 was treated by repeating the procedures as described in Example 5, except that (1) the rate of the air stream was 12 m/sec, (2) a voltage with a pulse wave having a rising and falling time of 0.4 μsec, and a pulse width of about 1 μsec, (3) the power applied was 3 W/cm$^2$, and (4) the time for applying the AC-high voltage was about 5 seconds.

When water was added dropwise, the untreated non-woven fabric showed practically no absorption of water droplets, whereas the treated non-woven fabric immediately absorbed water droplets. The treated non-woven fabric did not shrink in comparison with the untreated non-woven fabric.

Comparative Example 5

The non-woven fabric as used in Example 5 was treated by repeating the procedures as described in Example 9, except that an air stream was not passed. Many holes formed by a melting of the fibers of the non-woven fabric were observed.

Comparative Example 6

The non-woven fabric as used in Example 5 was treated by repeating the procedures as described in Example 9, except that the rate of the air stream was about 7 m/sec. Holes caused by melted fibers were observed in a part of the non-woven fabric.

Example 10

The article to be treated was of core-sheath type composite fibers (fineness=1.4 dtex; fiber diameter=about 14 μm) composed of a polypropylene core component and a polyethylene sheath component.

Then, the core-sheath type composite fibers were treated by repeating the procedures as described in Example 1, except that (1) the rate of the air stream was 250 m/sec, (2) the power applied was 13 W/cm$^2$, and (3) the time for applying the AC-high voltage was about 4 seconds.

The treated composite fibers did not shrink in comparison with the untreated composite fibers.

Figure 8:
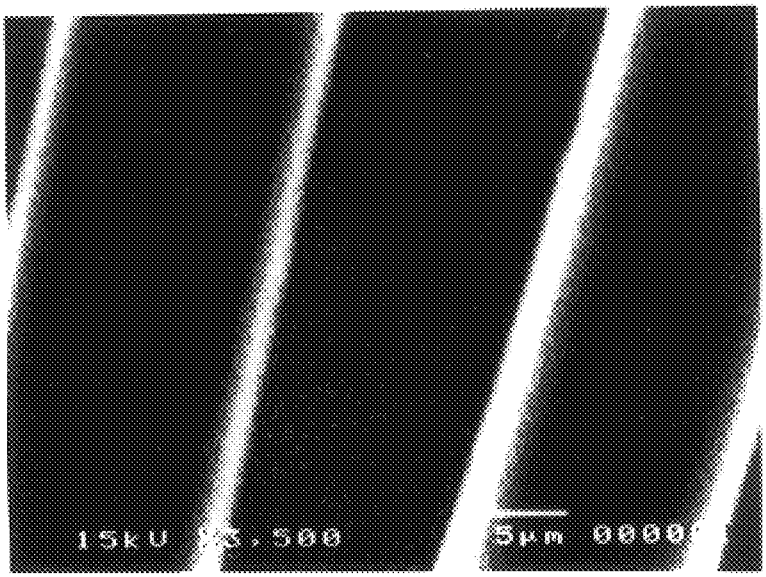
FIG. 8 is an electron micrograph of a composite fiber surface before a discharge treatment of Example 10.
Figure 9:
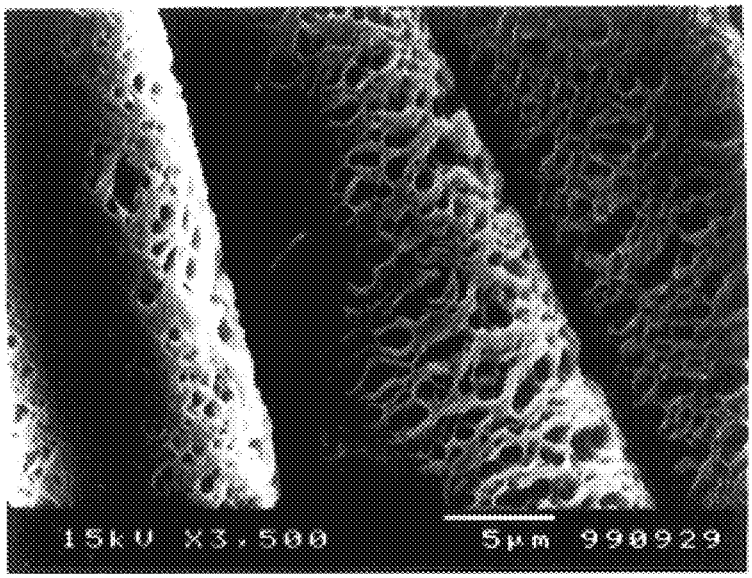
FIG. 9 is an electron micrograph of a composite fiber surface after the discharge treatment of Example 10.

The composite fiber surface before the discharge treatment is shown in an electron micrograph of FIG. 8, whereas the composite fiber surface after the discharge treatment is shown in an electron micrograph of FIG. 9. As apparent from FIGS. 8 and 9, a severely uneven structure was formed on the treated surface, and a surface area of the composite fiber was increased. This means that a roughening treatment was carried out by the discharge treatment.

Comparative Example 7

The core-sheath type composite fibers as used in Example 10 was treated by repeating the procedures as described in Example 10, except that an air stream was not passed. The core-sheath type composite fibers were completely melted.

Example 11

A melt-blown non-woven fabric (weight per unit area=30 g/m2; average fiber diameter =2 μm) composed of polypropylene was prepared.

Then, the non-woven fabric was treated by repeating the procedures as described in Example 1, except that (1) the rate of the air stream was 95 m/sec, (2) the power applied was 6 W/cm$^2$, and (3) the time for applying the AC-high voltage was about 1.5 seconds.

When water was added dropwise, the untreated non-woven fabric showed practically no absorption of water droplets, whereas the treated non-woven fabric immediately absorbed water droplets. The treated non-woven fabric did not shrink in comparison with the untreated non-woven fabric.

Example 12

The non-woven fabric as used in Example 11 was treated by repeating the procedures as described in Example 11, except that the power applied was 8 W/cm$^2$.

When water was added dropwise, the untreated non-woven fabric showed practically no absorption of water droplets, whereas the treated non-woven fabric immediately absorbed water droplets. The treated non-woven fabric did not shrink in comparison with the untreated non-woven fabric.

The results of Examples 1 to 12 and Comparative Examples 1 to 7 show that if the gas stream is passed at a rate of 10 m/sec or more, the discharge and roughening treatments can be carried out at a high density of the discharge energy without damaging the article, and in particular, when the AC-high voltage is a pulse wave, the rate of the gas stream is preferably 10 m/sec or more, whereas when the AC-high voltage is a wave (such as sinusoidal wave) other than a pulse wave, the rate of the gas stream is preferably 85 m/sec or more.

As above, according to the discharge treatment apparatus and method of the present invention, a high-speed discharge treatment can be stably carried out under a high density of the discharging energy without damaging the article, and the article surface can be roughened under a high density of the discharging energy.

The above advantageous effects are remarkable, when the alternating current-high voltage is a pulse wave, or the rate of gas is 85 m/sec or more.

In the present apparatus, a means for inducing an electric discharge can be miniaturized, because the density of the discharging energy can be raised.

Although the present invention has been described with reference to specific embodiments, various changes and modifications obvious to those skilled in the art are deemed to be within the spirit, scope, and concept of the invention.

What we claim is:

1. An apparatus for a discharge treatment, comprising:

a pair of electrodes located opposite to each other and spaced apart;

an arrangement for applying an alternating current-high voltage between said electrodes; and an arrangement for passing a gas mainly comprised of air at a rate of at least 10 m/sec through a space formed between said electrodes.

2. The apparatus according to claim 1, wherein the alternating current-high voltage is a pulse wave.

3. The apparatus according to claim 1, wherein the passing rate of the gas is at least 85 m/sec.

4. A process for a discharge treatment of an article, comprising the steps of:

applying an alternating current-high voltage between a pair of electrodes located opposite to each other and spaced apart, to said article placed between said electrodes, and passing a gas mainly comprised of air at a rate of at least 10 m/sec through a space formed between said electrodes, to thereby expose said article to an electric discharge induced between said electrodes.

5. The process according to claim 4, wherein the alternating current-high voltage is a pulse wave.

6. The process according to claim 4, wherein the passing rate of the gas is at least 85 m/sec.

* * * * *